US009343017B2

(12) United States Patent
Yamada

(10) Patent No.: US 9,343,017 B2
(45) Date of Patent: May 17, 2016

(54) DRIVING METHOD OF ELECTROPHORETIC DISPLAY DEVICE, AND CONTROLLER

(75) Inventor: Yusuke Yamada, Shiojiri (JP)

(73) Assignee: Seiko Epson Corporation (JP)

( * ) Notice: Subject to any disclaimer, the term of this patent is extended or adjusted under 35 U.S.C. 154(b) by 1034 days.

(21) Appl. No.: 13/028,486

(22) Filed: Feb. 16, 2011

(65) Prior Publication Data

US 2011/0216100 A1 Sep. 8, 2011

(30) Foreign Application Priority Data

Mar. 4, 2010 (JP) ..... 2010-048060

(51) Int. Cl.
*G09G 3/34* (2006.01)
*G09G 5/10* (2006.01)

(52) U.S. Cl.
CPC .. *G09G 3/34* (2013.01); *G09G 5/10* (2013.01); *G09G 3/344* (2013.01); *G09G 2310/068* (2013.01)

(58) Field of Classification Search
CPC ..... G09G 3/344; G09G 2310/068
USPC ..... 345/107, 296
See application file for complete search history.

(56) References Cited

U.S. PATENT DOCUMENTS

2004/0184136 A1* 9/2004 Goden ..... 359/296
2005/0270267 A1* 12/2005 Johnson ..... 345/107
2006/0071902 A1 4/2006 Zhou et al.
2006/0139305 A1 6/2006 Zhou et al.
2006/0290652 A1* 12/2006 Zhou et al. ..... 345/107
2007/0057905 A1* 3/2007 Johnson et al. ..... 345/107
2007/0057907 A1 3/2007 Ishii et al.
2007/0091418 A1* 4/2007 Danner et al. ..... 359/296
2007/0120812 A1 5/2007 Nagayama
2007/0132687 A1* 6/2007 Johnson ..... 345/89
2011/0216100 A1* 9/2011 Yamada ..... 345/690

FOREIGN PATENT DOCUMENTS

CN 1742312 A 3/2006
CN 102194414 A 9/2011
JP 2007-079170 3/2007

* cited by examiner

*Primary Examiner* — Amare Mengistu
*Assistant Examiner* — Joseph G Rodriguez
(74) *Attorney, Agent, or Firm* — Harness, Dickey & Pierce, P.L.C.

(57) ABSTRACT

A driving method of an electrophoretic display device, where a first display state and a second display state are respectively selected as a display state of one pixel by applying a voltage with a positive polarity or a negative polarity, and a halftone between the first display state and the second display state is selected according to a total duration of the negative polarity voltage applied to a pixel in the first display state, including setting a display state of the one pixel to the first display state; applying a compensating voltage pulse with the positive polarity to the one pixel; and applying a first driving voltage pulse with the negative polarity to the one pixel; wherein, the applying of the compensating voltage pulse is executed between the setting of the display state and the applying of the first driving voltage pulse.

14 Claims, 11 Drawing Sheets

DRIVING METHOD OF ELECTROPHORETIC DISPLAY DEVICE, AND CONTROLLER

BACKGROUND

1. Technical Field

The present invention relates to a driving method of an electrophoretic display device.

2. Related Art

In this type of electrophoretic display device, in regard to each of a plurality of pixels, an image is displayed by moving the electrophoretic particles through application of a driving voltage to, for example, an electrophoretic layer including white and black electrophoretic particles interposed between a pixel electrode and a common electrode. Additionally, by changing the period of time when the driving voltage is applied to the electrophoretic layer for each pixel, halftone (for example, gray) is displayed.

On the other hand, as this type of electrophoretic display device, there is an electrophoretic display device provided with a pixel circuit (a so-called 1T1C pixel circuit) configured to include one TFT (thin film transistor) which functions as a pixel switching element and one condenser which functions as a memory circuit (namely, a holding capacitor).

For example, in JP-A-2007-79170, a technology is disclosed for preventing an uneven display of color in a case of switching between display colors in an electrophoretic display device, by changing the application time of a driving voltage in accordance with the continuous display time of a display color displayed before switching.

In this type of electrophoretic display device, when displaying halftone, there is a technical problem in that there is a concern that noise may be generated in the displayed image. Namely, even if the same driving voltage is applied to display the same halftone in different pixels, there are cases where different halftones are displayed depending on the pixel. A difference in halftone such as this which is actually displayed by two pixels which are to display the same halftone is visually recognized as image noise. In a case where halftone is displayed, there is a tendency that noise is more notably generated as the duration of the driving voltage applied to display halftone becomes shorter. The cause is not clear but, for example, in an electrophoretic display device with a 1T1C pixel circuit as described above, manufacturing variations in the condenser included in each pixel circuit (in other words, differences in condenser characteristics between condensers provided for each pixel) are considered to be one of the causes.

SUMMARY

An advantage of some aspects of the invention is that a driving method of an electrophoretic display device is provided which is capable of reducing noise when displaying halftone and of performing high quality display.

A driving method of an electrophoretic display device of the invention which has a plurality of pixels where an electrophoretic layer is interposed between a first electrode and a second electrode, and in a case when the potential of the first electrode is higher than the potential of the second electrode, when the potential difference generated between the first electrode and the second electrode is a positive polarity, as a display state of one pixel out of the plurality of pixels, a first display state is selected by applying a voltage with the positive polarity and a second display state is selected by applying a voltage with a negative polarity different from the positive polarity, and a halftone between the first display state and the second display state is selected according to a total duration of the voltage with the negative polarity applied to the one pixel in the first display state, including setting the display state of the one pixel to the first display state, applying a compensating voltage pulse with the positive polarity to the one pixel, and applying a first driving voltage pulse with the negative polarity to the one pixel, where the applying of the compensating voltage pulse is executed between the setting of the display state and the applying of the first driving voltage pulse in regard to the one pixel.

According to the driving method of the electrophoretic display device of the invention, a pixel, which is applied with a voltage of one polarity such as a positive polarity and is in a first display state (for example, white), is applied with a compensating voltage pulse with the same polarity as the one polarity such as positive polarity and is applied with at least one driving voltage pulse with a polarity opposite to the one polarity such as a negative polarity, halftone (grayscale) which is, for example, gray is displayed in the pixel. In addition, the potential of the first electrode also becomes higher than the potential of the second electrode by applying the compensating voltage pulse with a positive polarity to the pixel. Furthermore, the potential of the first electrode also becomes lower than the potential of the second electrode only for a predetermined duration by applying the one driving voltage pulse with a negative polarity to the pixel. As such, in a case when a plurality of driving voltage pulses with the negative polarity is applied to the pixel, the potential of the first electrode also becomes lower than the potential of the second electrode only for the total duration which is the total of the respective durations of the plurality of driving voltage pulses with the negative polarity.

In the invention, in particular, when selecting halftone, in the case when the potential of the first electrode is higher than the potential of the second electrode, when the potential difference generated between the first electrode and the second electrode is a positive polarity, in regards to a pixel where the first display state is selected, after the compensating voltage pulse with the positive polarity is applied, at least one driving voltage pulse with the negative polarity is applied. In detail, when selecting halftone (in other words, when displaying halftone), first, the first display state is selected as the display state of the pixel which is to display halftone. That is, the pixel where halftone is to be selected is initially set to the first display state such as white by applying a voltage with the positive polarity between the first and the second electrodes of the pixel where halftone is to be selected. Next, the compensating voltage pulse with the positive polarity is applied to the pixel where the first display state is selected. That is, a voltage with the positive polarity is applied only for the duration of the compensating voltage pulse with the positive polarity between the first and second electrodes of the pixel where the first display state is selected. Namely, after a voltage with the positive polarity is applied between the first and second electrodes to select the first display state, a voltage with the positive polarity is further applied between the first and second electrodes only for the duration of the compensating voltage pulse with the positive polarity. Next, at least one driving voltage pulse with the negative polarity is applied to the pixel where the first display state is selected (in other words, the pixel applied with the compensating voltage pulse with the positive polarity) so as to come closer to halftone which is to be displayed. According to this, it is possible to display halftone in the pixel which is to display halftone.

According to the invention, compared to a case when halftone is displayed by applying only the driving voltage pulse with the negative polarity to the pixel which is to display halftone, it is possible to reduce or eliminate noise in a displayed image. That is, it is possible to reduce the displaying of a halftone which differs between pixels which are to display the same halftone. As a result, it is possible to perform a high quality display.

In addition, it is preferable if the at least one driving voltage pulse with the negative polarity is applied immediately after (for example, within one second since the compensating voltage pulse with the positive polarity is applied) the application of the compensating voltage pulse with the positive polarity to the pixel which is to display halftone. In this case, it is possible to further reliably reduce or eliminate noise such as that described above. That is, the shorter the time from when the compensating voltage pulse with the positive polarity is applied until the at least one driving voltage pulse with the negative polarity is applied, it is possible to further reliably reduce or eliminate noise such as that described above.

As described above, according to the driving method of the electrophoretic display device of the invention, it is possible to reduce noise when a halftone is displayed and it is possible to perform a high quality display.

According to an aspect of the driving method of the electrophoretic display device of the invention, in the applying of the first driving voltage pulse, at least two or more driving voltage pulses with the negative polarity are applied to the one pixel and the driving voltage pulse with the shortest duration out of the at least two or more driving voltage pulses with the negative polarity is applied to the one pixel before the other driving voltage pulses.

According to the aspect, since it is possible to make the interval between the driving voltage pulse with the shortest duration applied to the pixel which is, for example, to display the halftone closest to the first display state (for example, white) and the other driving voltage pulses as short as possible, it is possible to increase the effects of reducing or preventing image noise as much as possible.

According to another aspect of the driving method of the electrophoretic display device of the invention, further, there is a plurality of scanning lines and a plurality of data lines, where a first pixel out of the plurality of pixels corresponds to a first scanning line out of the plurality of scanning lines and a second pixel out of the plurality of pixels corresponds to a second scanning line out of the plurality of scanning lines, and a display state of the first pixel and a display state of the second pixel is set to the first display state in the setting of the display state, when the first scanning line is selected, the applying of the compensating voltage pulse and the applying of the first driving voltage pulse are executed with regard to the first pixel, and when the second scanning line is selected, the applying of the compensating voltage pulse and the applying of the first driving voltage pulse are executed with regard to the second pixel.

According to the aspect, it is possible to execute the applying of the compensating voltage pulse and the applying of the first driving voltage pulse in a short interval with regard to each of the first pixel and the second pixel, and it is possible to increase the effects of reducing or preventing image noise.

According to a still another aspect of the driving method of the electrophoretic display device of the invention, the duration of the compensating voltage pulse is shorter than the total duration of the at least one driving voltage pulse with the negative polarity.

According to the aspect, it is possible to effectively reduce or eliminate noise in a displayed image. Additionally, compared to a case when the duration of the compensating voltage pulse with the positive polarity is longer than the total duration of the at least one driving voltage pulse with the negative polarity, it is possible to swiftly display halftone. That is, it is possible to shorten the time required for displaying halftone which is to be displayed. Furthermore, it is possible to suppress the power consumption required to apply the compensating voltage pulse with the positive polarity.

According to a still another aspect of the driving method of the electrophoretic display device of the invention, the duration of the compensating voltage pulse is longer than the total duration of the at least one driving voltage pulse with the negative polarity.

According to the aspect, even in a case where, for example, it is more difficult to move the electrophoretic particles included in the electrophoretic layer when a voltage with a positive polarity is applied to a pixel than when a voltage with a negative polarity is applied to a pixel, it is possible to reliably reduce or eliminate noise on the display such as that described above.

In addition, the duration of the compensating voltage pulse with the positive polarity may be set based on, for example, characteristics of the electrophoretic particles included in the electrophoretic layer (for example, the ease of movement of the electrophoretic particles).

According to a still another aspect of the driving method of the electrophoretic display device of the invention, the applying of the compensating voltage pulse is not executed with regard to a pixel where the second display state is selected out of the plurality of pixels.

According to the aspect, it is possible to reliably set the display state of the pixel which is to display the second display state to the second display state.

That is, according to the aspect, in a case when a pixel in the first display state (for example, white) is to be set in the second display state (for example, black), with regard to the pixel, only the driving voltage pulse with the negative polarity is applied and the compensating voltage pulse with the positive polarity is not applied. As such, it is possible to prevent the pixel which is to become the second display state from becoming a display state (for example, gray) closer to the first display state than the second display state due to the application of the compensating voltage pulse with the positive polarity.

The actions and other advantages of the invention will be made clear from the embodiment for executing the invention described next.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, the embodiments of the invention are described while referring to the diagrams.

First Embodiment

A driving method of an electrophoretic display device according to the first embodiment will be described with reference to FIGS. 1 to 8.

First, an overall configuration of the electrophoretic display device according to the embodiment will be described with reference to FIGS. 1 and 2.

Figure 1:
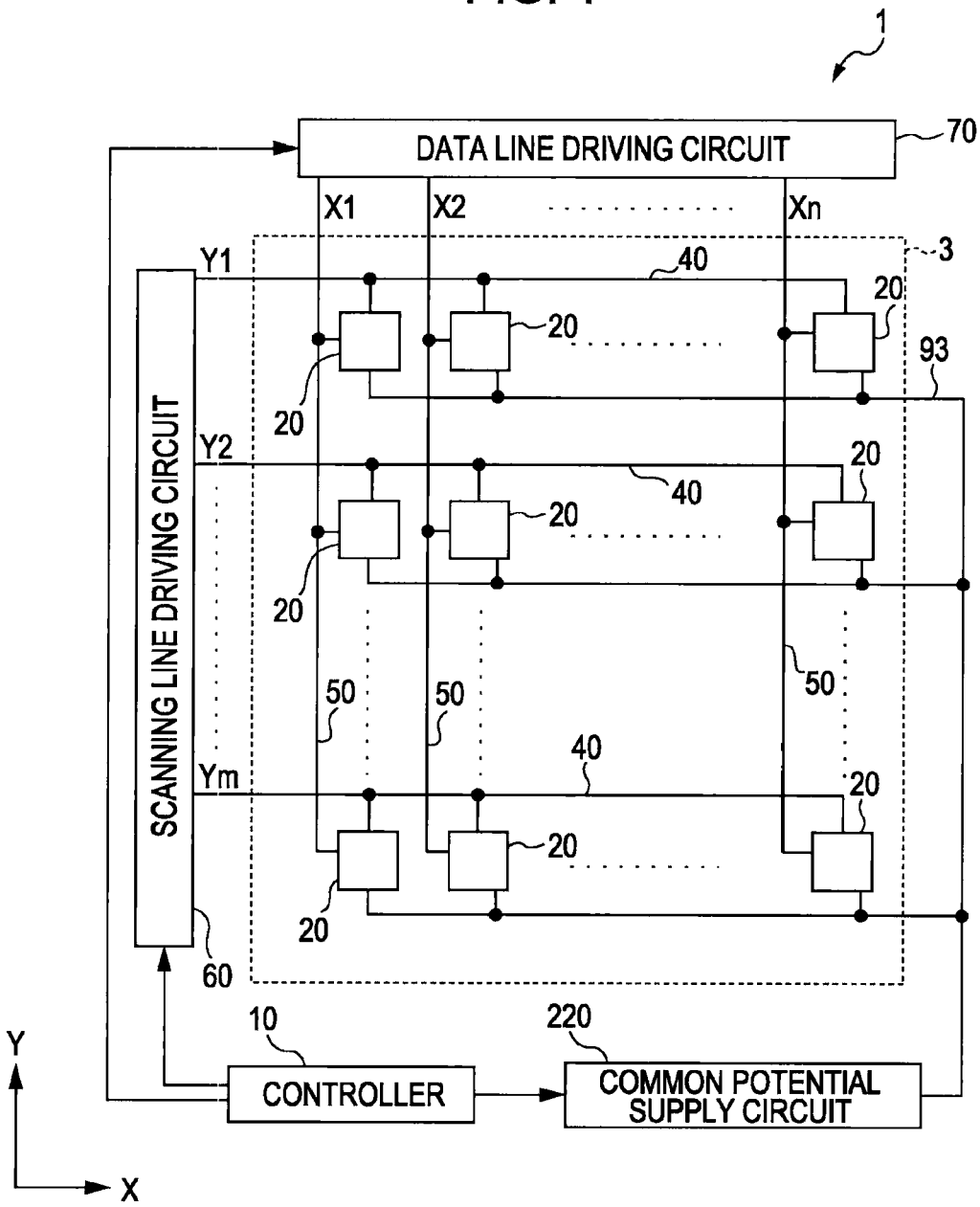
FIG. 1 is a block diagram illustrating an overall configuration of an electrophoretic display device according to a first embodiment.

FIG. 1 is a block diagram illustrating the overall configuration of the electrophoretic display device according to the embodiment.

In FIG. 1, an electrophoretic display device 1 according to the embodiment includes a display unit 3, a controller 10, a scanning line driving circuit 60, a data line driving circuit 70 and a common potential supply circuit 220.

In the display unit 3, m rows and n columns of pixels 20 are arranged in a matrix (two dimensional planar) shape. Also, in the display unit 3, m scanning lines 40 (that is, scanning lines Y1, Y2, . . . , Ym) and n data lines 50 (that is, data lines X1, X2, . . . , Xn) are provided to intersect with each other. Specifically, the m scanning lines 40 extend in a row direction (that is, an X direction) and the n data lines 50 extend in a column direction (that is, a Y direction). The pixels 20 are arranged to correspond to the intersections of the m scanning lines 40 and the n data lines 50.

The controller 10 controls the operations of the scanning line driving circuit 60, the data line driving circuit 70, and the common potential supply circuit 220. The controller 10 supplies timing signals such as clock signals and start pulses to each circuit.

The scanning line driving circuit 60 supplies scanning signals to each of the scanning lines Y1, Y2, . . . , Ym based on timing signals supplied from the controller 10.

The data line driving circuit 70 supplies data signals to the data lines X1, X2, . . . , Xn based on timing signals supplied from the controller 10. The data signals take on potentials with 2 values, a high potential VH (for example, 15V) or a low potential VL (for example, 0V).

The common potential supply circuit 220 supplies a common potential Vcom to a common potential line 93.

In addition, various types of signals are input and output in the controller 10, the scanning line driving circuit 60, the data line driving circuit 70, and the common potential supply circuit 220. However, descriptions of signals which have no particular relevance to the embodiment are not included.

Figure 2:
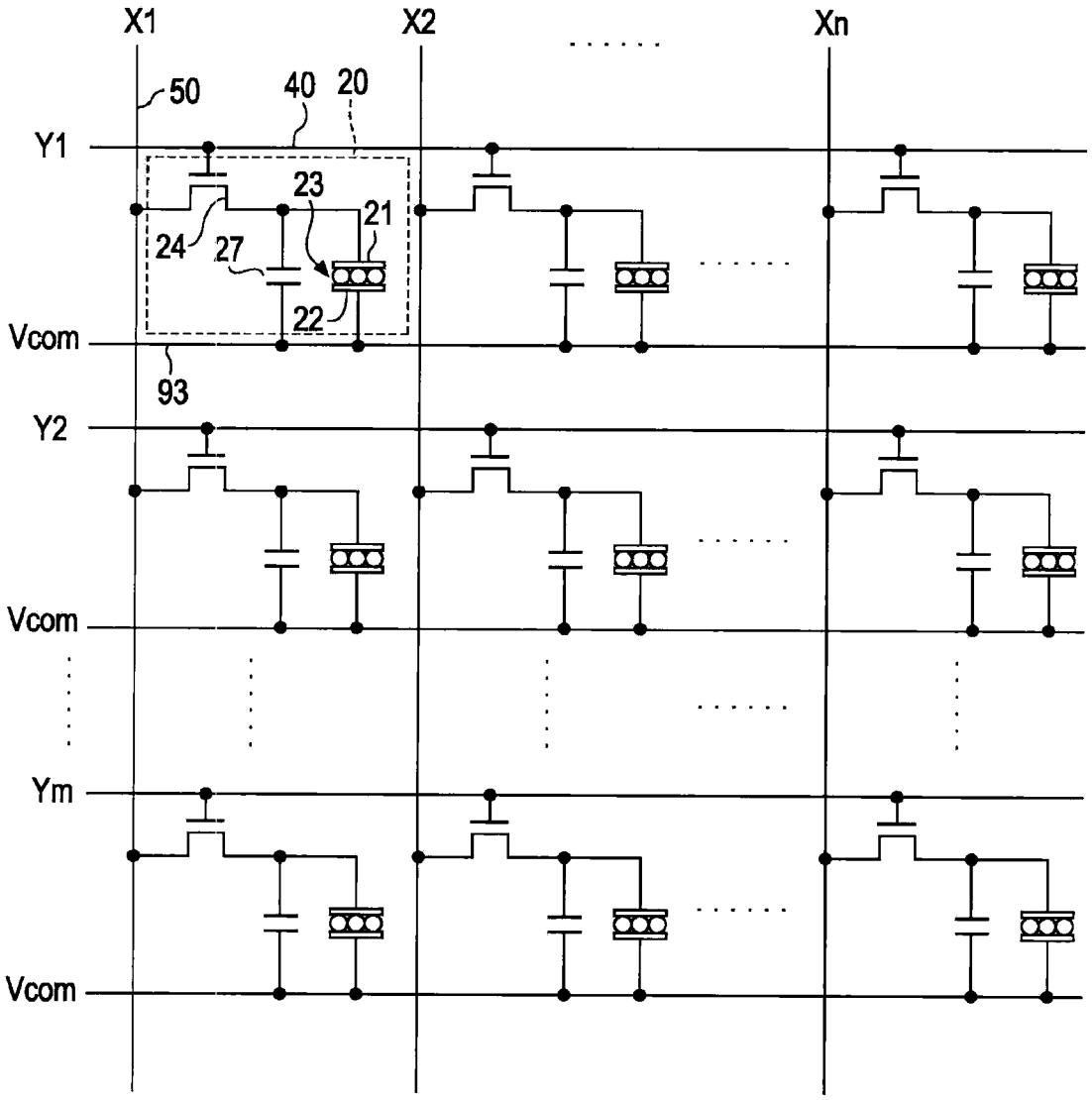
FIG. 2 is an equivalent circuit diagram illustrating an electrical configuration of a pixel of the electrophoretic display device according to the first embodiment.

FIG. 2 is an equivalent circuit diagram illustrating an electrical configuration of a pixel.

In FIG. 2, the pixel 20 includes a pixel circuit (namely, a 1T1C type pixel circuit) which has a pixel switching transistor 24 and a condenser (retention capacity) 27, a pixel electrode 21, a common electrode 22 and an electrophoretic layer 23.

The pixel switching transistor 24 is configured as, for example, an N type transistor. The gate of the pixel switching transistor 24 is electrically connected to the scanning line 40, the source of the pixel switching transistor 24 is electrically connected to the data line 50, and the drain of the pixel switching transistor 24 is electrically connected to the pixel electrode 21 and the condenser 27. The pixel switching transistor 24 outputs the data signals supplied from the data line driving circuit 70 (refer to FIG. 1) via the data line 50 to the pixel electrode 21 and the condenser 27 at a timing corresponding to the scanning signals supplied from the scanning lines driving circuit 60 (refer to FIG. 1) via the scanning line 40.

In the pixel electrode 21, the data signals are supplied from the data line driving circuit 70 via the data line 50 and the pixel switching transistor 24. The pixel electrode 21 is arranged to face the common electrode 22 through the electrophoretic layer 23.

The common electrode 22 is electrically connected to the common potential line 93 which is supplied with the common potential Vcom.

The electrophoretic layer 23 includes a plurality of microcapsules which each include electrophoretic particles.

The condenser 27 is formed from a pair of electrodes arranged to face each other through a dielectric film. One of the electrodes is electrically connected to the pixel electrode 21 and the pixel switching transistor 24, and the other electrode is electrically connected to the common potential line 93. It is possible to hold the data signals only for a predetermined period of time using the condenser 27.

Next, a specific configuration of a display unit of the electrophoretic display device according to the embodiment is described with reference to FIGS. 3 and 4.

Figure 3:
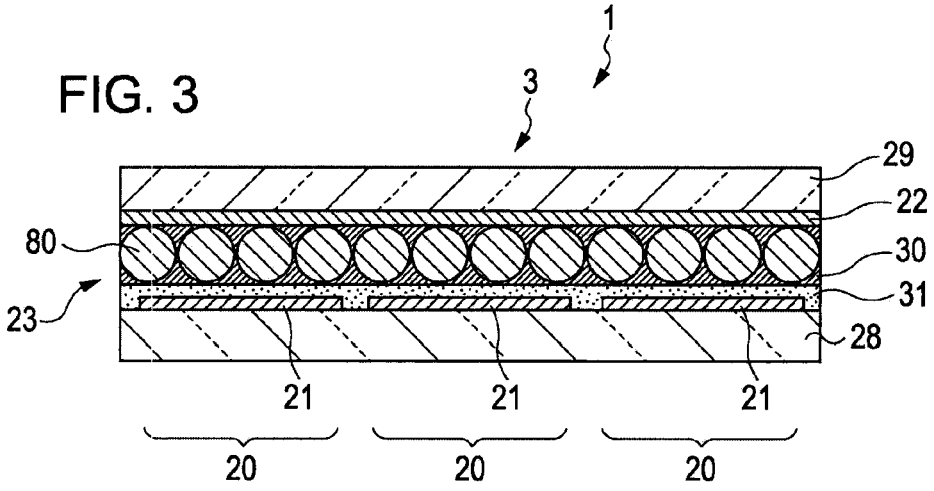
FIG. 3 is a partial cross-sectional diagram of a display unit of the electrophoretic display device according to the first embodiment.

FIG. 3 is a partial cross-sectional diagram of the display unit of the electrophoretic display device according to the embodiment.

In FIG. 3, the display unit 3 has the configuration where the electrophoretic layer 23 is interposed between an element substrate 28 and an opposing substrate 29. In addition, in the embodiment, the description is made assuming that an image is displayed on the opposing substrate 29 side.

The element substrate 28 is a substrate formed from, for example, glass, plastic or the like. Although not shown diagrammatically here, on the element substrate 28, a laminate structure is formed with the pixel switching transistor 24, the condenser 27, the scanning line 40, the data line 50, the common potential line 93 and the like described above with reference to FIG. 2. A plurality of the pixel electrodes 21 are provided in a matrix shape on the upper layer side of the laminate structure.

The opposing substrate 29 is a transparent substrate formed from, for example, glass, plastic or the like. On a surface of the opposing substrate 29 which faces the element substrate 28, the common electrode 22 is formed so as to face the plurality of pixel electrodes 21. The common electrode 22 is formed from a transparent and conductive material such as, for example, magnesium-silver (MgAg), indium tin oxide (ITO), and indium zinc oxide (IZO).

The electrophoretic layer 23 includes a plurality of microcapsules 80 which each include electrophoretic particles and is fixed between the element substrate 28 and the opposing substrate 29 by a binder 30 and an adhesive layer 31 formed from, for example, resin or the like. In addition, the electrophoretic display device 1 according to the embodiment is configured in a manufacturing process by an electrophoretic sheet, which is formed from the electrophoretic layer 23 being fixed in advance to the opposing substrate 29 side by the binder 30, being attached to the element substrate 28 side where the pixel electrode 21 and the like, which are manufactured separately, are bonded by the adhesive layer 31.

The microcapsules 80 are interposed between the pixel electrode 21 and the common electrode 22, and one or a plurality are arranged in one pixel 20 (in other words, in relation to one pixel electrode 21).

Figure 4:
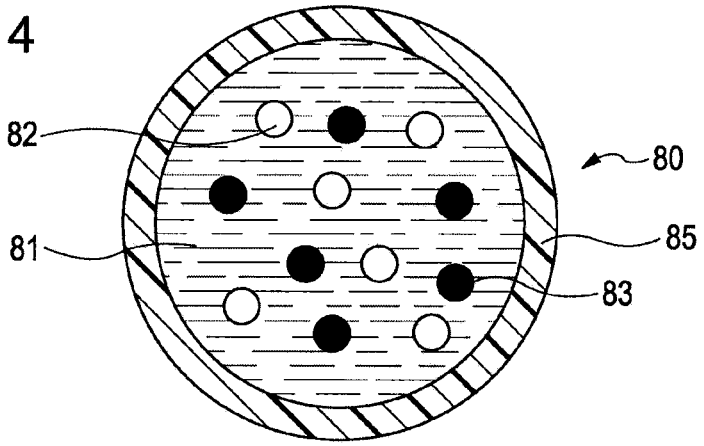
FIG. 4 is a schematic diagram illustrating a configuration of a microcapsule.

FIG. 4 is a schematic diagram illustrating a configuration of a microcapsule. In addition, in FIG. 4, a cross-section of the microcapsule is schematically shown.

In FIG. 4, the microcapsules 80 have enclosed a dispersion medium 81 inside of a coating 85, a plurality of white particles 82 and a plurality of black particles 83. The microcapsules 80 are formed in a spherical shape with a particle diameter of, for example, approximately 50 μm.

The coating 85 functions as the outer shell of the microcapsule 80 and is formed from a transparent polymer resin such as an acrylic resin such as polymethyl methacrylate or polyethyl ethacrylate, urea resin, gum Arabic or gelatin.

The dispersion medium 81 is a medium dispersing the white particles 82 and the black particles 83 in the microcapsules 80 (in other words, in the coating 85). As the dispersion medium 81, water, alcohol based solvents such as methanol, ethanol, isopropanol, butanol, octanol, or methyl cellosolve, various types of esters such as ethyl acetate or butyl acetate, ketones such as acetone, methyl ethyl ketone or methyl isobutyl ketone, aliphatic hydrocarbons such as pentane, hexane, or octane, alicyclic hydrocarbons such as cyclohexane or methylcyclohexane, aromatic hydrocarbons such as benzene, toluene, xylene or benzenes with a long-chain alkyl group such as hexyl benzene, heptyl benzene, octyl benzene, nonyl benzene, decyl benzene, undecyl benzene, dodecyl benzene, tridecyl benzene or tetradecyl benzene, halogenated hydrocarbons such as methylene chloride, chloroform, carbon tetrachloride or 1,2-dichloroethane, carboxylate or other oils, can be used singularly or in combination. Also, in the dispersion medium 81, a surfactant may be included.

The white particles 82 are particles (polymer or colloid) formed from a white pigment such as titanium dioxide, Chinese white (zinc oxide) or antimony trioxide, and for example, are negatively charged.

The black particles 83 are particles (polymer or colloid) formed from a black pigment such as aniline black or carbon black, and for example, are positively charged.

As a result, the white particles 82 and the black particles 83 can be moved within the dispersion medium 81 using an electrical field generated by a difference in potential between the pixel electrode 21 and the common electrode 22.

In these pigments, electrolytes, surfactants, metallic soaps, resins, rubber, oils, varnishes, charge control agents formed from particles such as compounds, dispersants such as titanium-based coupling agents, aluminum-based coupling agents and silane-based coupling agents, lubricants, stabilizers and the like can be added as required.

In the FIGS. 3 and 4, in a case when a voltage is applied between the pixel electrode 21 and the common electrode 22 so that the potential of the common electrode 22 becomes relatively higher, the black particles 83 which are positively charged are drawn toward the pixel electrode 21 side in the microcapsule 80 due to Coulomb force and the white particles 82 which are negatively charged are drawn toward the common electrode 22 side in the microcapsule 80 due to Coulomb force. As a result, due to the white particles 82 collecting at the display surface side in the microcapsule 80 (that is, the common electrode 22 side), it is possible to display the color of the white particles 82 (that is, white) on the display surface of the display unit 3. Conversely, in a case when a voltage is applied between the pixel electrode 21 and the common electrode 22 so that the potential of the pixel electrode 21 becomes relatively higher, the white particles 82 which are negatively charged are drawn toward the pixel electrode 21 side due to Coulomb force and the black particles 83 which are positively charged are drawn toward the common electrode 22 side due to Coulomb force. As a result, due to the black particles 83 collecting at the display surface side in the microcapsule 80, it is possible to display the color of the black particles 83 (that is, black) on the display surface of the display unit 3.

In addition, below, in the case when the potential of the common electrode 22 is higher than the potential of the pixel electrode 21, the difference in potential (that is, voltage) generated between the common electrode 22 and the pixel electrode 21 is appropriately referred to as a "positive polarity voltage", and in the case when the potential of the common electrode 22 is lower than the potential of the pixel electrode 21, the difference in potential generated between the common electrode 22 and the pixel electrode 21 is appropriately referred to as a "negative polarity voltage". In addition, the common electrode 22 is an example of the "first electrode" according to the invention, and the pixel electrode 21 is an example of the "second electrode" according to the invention.

That is, it is possible to display white in the pixel 20 by applying a positive polarity voltage to the pixel 20, and it is possible to display black in the pixel 20 by applying a negative polarity voltage to the pixel 20. In addition, a state where the pixel 20 displays white is an example of the "first display state" according to the invention and a state where the pixel 20 displays black is an example of the "second display state" according to the invention.

Furthermore, it is possible to display grays, such as light gray, gray and dark gray, which are halftones (that is, intermediate gradation) between white and black due to the dispersion state of the white particles 82 and the black particles 83 between the pixel electrodes 21 and the common electrodes 22. For example, after the white particles 82 collect at the display surface side of the microcapsule 80 and the black particles 83 collect at the pixel electrode 21 side due to a voltage applied between the pixel electrode 21 and the common electrode 22 so that the potential of the common electrode 22 becomes relatively higher (that is, by applying a positive polarity voltage), the black particles 83 are moved by a predetermined amount to the display surface side of the microcapsule 80 and the white particles 82 are moved by a predetermined amount to the pixel electrode 21 side due to a voltage applied between the pixel electrode 21 and the common electrode 22 so that the potential of the pixel electrode 21 becomes relatively higher (that is, by applying a negative polarity voltage) for only a predetermined period of time corresponding to halftone to be displayed. As a result, it is possible to display gray which is a halftone between white and black on the display surface of the display unit 3.

In addition, it is possible to display red, green, blue and the like by changing the pigments used in the white particles 82 and the black particles 83 with, for example, pigments which are red, green, blue or the like.

Next, a driving method of the electrophoretic display device according to the embodiment will be described with reference to FIGS. 5 to 8.

Figure 5:
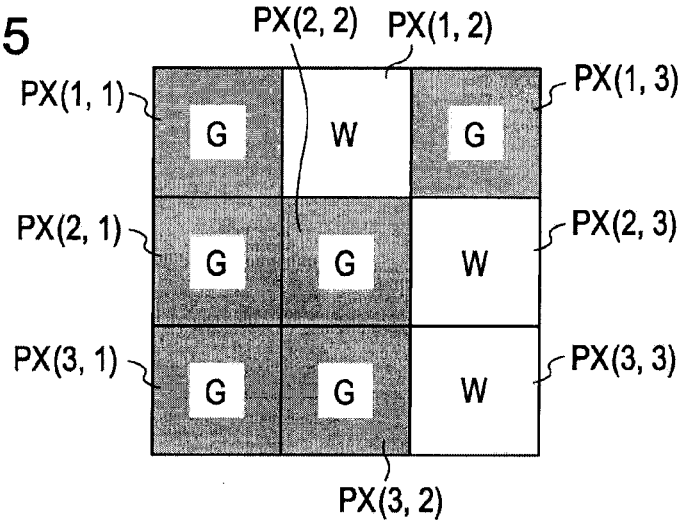
FIG. 5 is a schematic diagram illustrating the display unit of the electrophoretic display device in a state where an example of an image including halftone is displayed.

Below, for the sake of the description, as shown in FIG. 5, a case, where an image including halftone is displayed on the display unit 3 where the pixels 20 are arranged in 3 rows×3 columns using the driving method of the electrophoretic display device according to the embodiment, is taken as an example. Here, FIG. 5 is a schematic diagram illustrating the display unit of the electrophoretic display device in a state where an example of an image including halftone is displayed.

That is, as shown in FIG. 5, a case where a pixel PX(1,1) displays gray (G), a pixel PX(1,2) displays white (W), a pixel PX(1,3) displays gray (G), a pixel PX(2,1) displays gray (G), a pixel PX(2,2) displays gray (G), a pixel PX(2,3) displays white (W), a pixel PX(3,1) displays gray (G), a pixel PX(3,2) displays gray (G), and a pixel PX(3,3) displays white (W), is taken as an example. In addition, in the display unit 3, 3 rows×3 columns of the pixels 20 (that is, the pixel PX(1,1), the pixel PX(1,2), the pixel PX(1,3), . . . , the pixel PX(3,1), the pixel PX(3,2), the pixel PX(3,3)) are arranged in a matrix shape. Additionally, in the display unit 3, three scanning lines 40 (that is, scanning lines Y1, Y2 and Y3) and three data lines 50 (that is, data lines X1, X2 and X3) are provided (refer to FIG. 1). The pixel PX(1,1) is arranged to correspond to the intersection of the scanning line Y1 and data line X1, the pixel PX(1,2) is arranged to correspond to the intersection of the scanning line Y1 and data line X2, the pixel PX(1,3) is arranged to correspond to the intersection of the scanning line Y1 and data line X3, the pixel PX(2,1) is arranged to correspond to the intersection of the scanning line Y2 and data line X1, the pixel PX(2,2) is arranged to correspond to the intersection of the scanning line Y2 and data line X2, the pixel PX(2,3) is arranged to correspond to the intersection of the scanning line Y2 and data line X3, the pixel PX(3,1) is arranged to correspond to the intersection of the scanning line Y3 and data line X1, the pixel PX(3,2) is arranged to correspond to the intersection of the scanning line Y3 and data line X2, and the pixel PX(3,3) is arranged to correspond to the intersection of the scanning line Y3 and data line X3.

Figure 6:
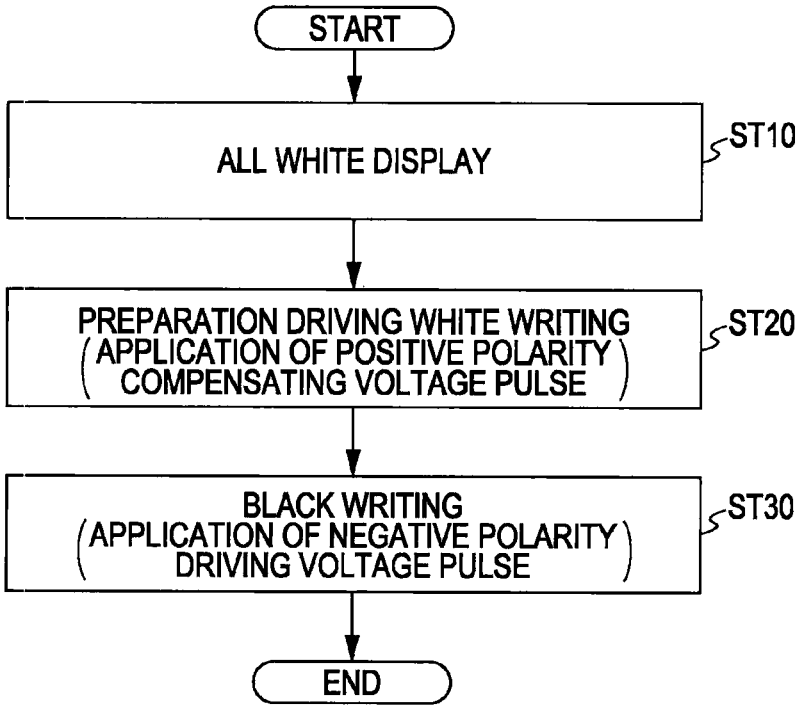
FIG. 6 is a flow chart illustrating a driving method of the electrophoretic display device according to the first embodiment.

FIG. 6 is a flow chart illustrating the driving method of the electrophoretic display device according to the embodiment.

In FIG. 6, according to the driving method of the electrophoretic display device according to the embodiment, when displaying the image including halftone as show in FIG. 5 for example, first, all white display (step ST10) is performed. That is, white (W) is displayed in all of the pixels 20 by applying a positive polarity voltage to all of the pixels 20 in the display unit 3. More specifically, in the pixel PX(1,1) for example, data signals from the data line X1 via the pixel switching transistor 24 accumulate in the condenser 27, a voltage with the high potential VH is supplied to the pixel electrode 21 only for a predetermined period of time, and the common potential Vcom with the low potential VL is supplied to the common electrode 22 from the common potential supply circuit 220.

Next, preparation driving white writing (step ST20) is performed. That is, Coulomb force toward the common electrode 22 side (that is, display surface side) is added to the white particles 82 and Coulomb force toward the pixel electrode 21 side is added to the black particles 83 by applying a positive polarity compensating voltage pulse Pc1 (refer to FIG. 8 described later) to all of the pixels 20 in the display unit 3. That is, Coulomb force toward the common electrode 22 side (that is, display surface side) is added to the white particles 82 and Coulomb force toward the pixel electrode 21 side is added to the black particles 83 by applying a positive polarity voltage between the pixel electrode 21 and the common electrode 22 in all of the pixels 20.

Figure 7:
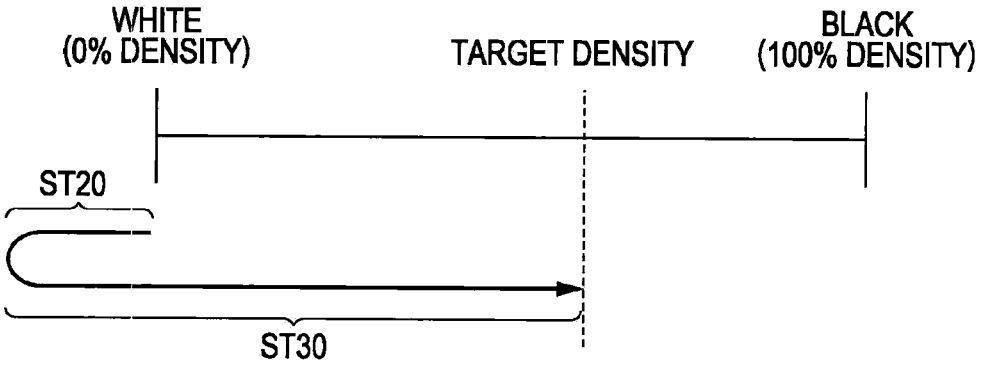
FIG. 7 is a conceptual diagram illustrating the driving method of the electrophoretic display device according to the first embodiment.

FIG. 7 is a conceptual diagram illustrating the driving method of the electrophoretic display device according to the embodiment. In addition, in FIG. 7, the density of gray which is halftone is represented by white as being 0% density and black as being 100% density.

As shown in FIG. 7, in the preparation driving white writing (step ST20), a positive polarity voltage is further applied to the pixel 20 which displays white due to a positive polarity voltage being applied only for a predetermined period of time in the step ST10. In other words, in the preparation driving white writing (step ST20), a positive polarity voltage which is a voltage which further lowers the density is applied to the pixel 20 displaying white (0% density). In addition, even if a positive polarity voltage is applied to the pixel 20 displaying white, the pixels 20 remains in the state of displaying white and there is very little or no change in the density of the pixel 20. FIG. 7 is written so that there is a change in the density of the pixel 20 in step ST20 to make the invention easy to understand.

In FIGS. 6 and 7, after the preparation driving white writing (step ST20) is performed, black writing (step ST30) is performed. In the black writing (step ST30), a negative polarity driving voltage is applied only for a predetermined period of time to the pixel 20 which is to display gray so as to display the gray to be displayed (that is, target density of gray). In other words, a negative polarity driving voltage pulse Pa1 (refer to FIG. 8 described later) with a duration Ta1 (refer to FIG. 8 described later) set in advance to correspond to halftone to be displayed is applied to the pixel 20 which is to display halftone. That is, the black particles 83 are moved by a predetermined amount to the common electrode 22 side (that is, the display surface side) and the white particles 82 are moved by only a predetermined amount to the pixel electrode 21 side by applying a negative polarity voltage between the pixel electrode 21 and the common electrode 22 of the pixels 20 which are to display gray (G) in the display unit 3 (that is, in the example shown in FIG. 5, the pixel PX(1,1), the pixel PX(1,3), the pixel PX(2,1), the pixel PX(2,2), the pixel PX(3,1), and the pixel PX(3,2)).

Figure 8:
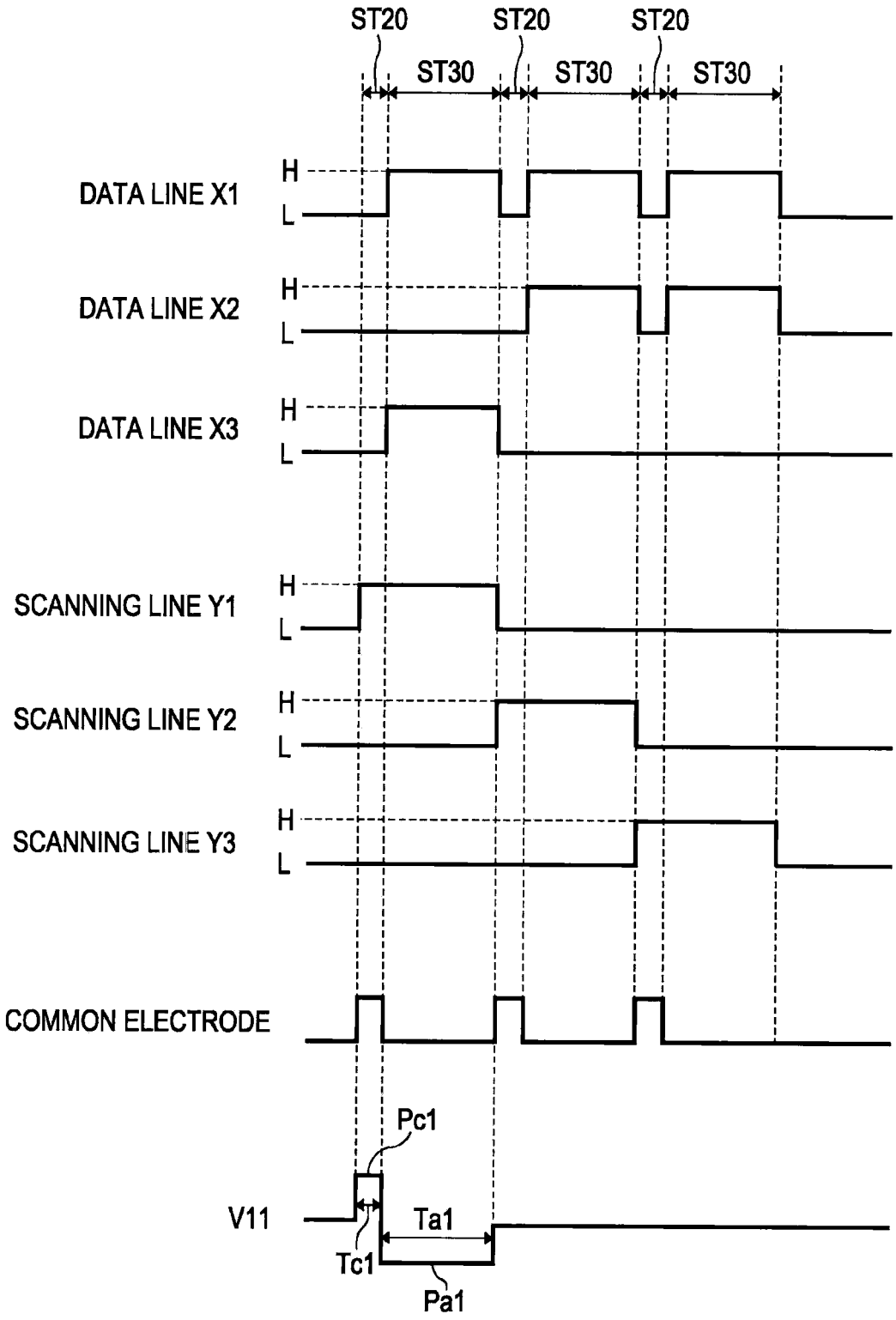
FIG. 8 is a timing chart for describing in detail the driving method of the electrophoretic display device according to the first embodiment.

FIG. 8 is a timing chart for describing in detail the driving method of the electrophoretic display device according to the embodiment. In addition, FIG. 8 shows the change in the potential of the data lines X1, X2 and X3, the scanning lines Y1, Y2 and Y3 and the common electrode 22 in the preparation driving white writing (step ST20) and the black writing (step ST30). Additionally, V11 shows the driving voltage waveform applied to the pixel PX(1,1).

As shown in FIG. 8, for each period when each of the scanning lines Y1, Y2 and Y3 are selected (that is, the period when the potential of each of the scanning lines Y1, Y2 and Y3 is at a high level), the preparation driving white writing (step ST20) and the black writing (step ST30) are performed. In the preparation driving white writing (step ST20), the positive polarity compensating voltage pulse Pc1 with the duration Tc1 is applied to all of the pixels 20. In the black writing (step ST30), the negative polarity driving voltage pulse Pa1 with the duration Ta1 is applied to the pixels 20 which are to display gray.

Specifically, after the all white display (step ST10) which is not shown in FIG. 8 is performed, first, the scanning line Y1 is set to a high level (that is, a high level scanning signal is supplied to the scanning line Y1). In the period in which scanning line Y1 is at a high level, the preparation driving white writing (step ST20) is performed by supplying a data signal with the low potential VL to the data lines X1, X2 and X3 and setting the common electrode 22 to the high potential VH for a time Tc1 (that is, the common potential Vcom is set as the high potential VH). After the preparation driving white writing, the black writing (step ST30) is performed by supplying a data signal with the high potential VH to the data line X1 only for a time Ta1, supplying a data signal with the low potential VL to the data line X2, supplying a data signal with the high potential VH to the data line X3 only for the time Ta1, and setting the common electrode 22 to the low potential VL (that is, the common potential Vcom is set as the low potential VL).

Next, the scanning line Y2 is set to a high level. In the period in which scanning line Y2 is at a high level, the preparation driving white writing (step ST20) is performed by supplying a data signal with the low potential VL to the data lines X1, X2 and X3 and setting the common electrode 22 to the high potential VH for the time Tc1. After the preparation driving white writing, the black writing (step ST30) is performed by supplying a data signal with the high potential VH to the data line X1 only for the time Ta1, supplying a data signal with the high potential VH to the data line X2 only for the time Ta1, supplying a data signal with the low potential VL to the data line X3, and setting the common electrode 22 to the low potential VL.

Next, the scanning line Y3 is set to a high level. In the period in which scanning line Y3 is at a high level, the preparation driving white writing (step ST20) is performed by supplying a data signal with the low potential VL to the data lines X1, X2 and X3 and setting the common electrode 22 to the high potential VH for the time Tc1. After the preparation driving white writing, the black writing (step ST30) is performed by supplying a data signal with the high potential VH to the data line X1 only for the time Ta1, supplying a data signal with the high potential VH to the data line X2 only for the time Ta1, supplying a data signal with the low potential VL to the data line X3, and setting the common electrode 22 to the low potential VL.

According to such a driving method, it is possible to display an image including halftone as shown in FIG. 5 with high quality on the display unit 3.

Here, as described above, in the embodiment, when an image including halftone as shown in FIG. 5 is displayed after the all white display (step ST10) is performed, black writing (step ST30) is performed after the preparation driving white writing (step ST20) is performed. That is, when halftone is displayed in the pixel 20 where the all white display (step ST10) has performed, after the positive polarity compensating voltage pulse Pc1 is applied to all of the pixels 20, the negative polarity driving voltage pulse Pa1 is applied to the pixels which are to display halftone. According to this, it is possible to reduce or eliminate display image noise. That is, it is possible to reduce the displaying of halftone which differs between pixels 20 which are to display the same halftone. Namely, according to the driving method of the electrophoretic display device according to the embodiment, for example, compared to a case when the pixel 20 displays halftone due to only a negative polarity driving voltage pulse being applied to the pixel 20 which is to display halftone, it is possible to effectively reduce or eliminate noise (that is noise when displaying halftone) which has a tendency to be notably generated as the time when the driving voltage is applied as described above becomes shorter. As a result, it is possible to perform a high quality display.

An effect of providing the preparation driving white writing (step ST20) according to the invention becomes larger as the interval between the preparation driving white writing (step ST20) and the black writing (step ST30) is shorter. As a result, as in the embodiment, the largest effect can be obtained when the black writing (step ST30) is performed immediately after the preparation driving white writing (step ST20) is performed for each one scanning line selected with regard to the pixel selected by the scanning line.

In addition, as described above, it can be considered that the display image noise generated when displaying halftone is due to a case where time from the application of the driving voltage to the pixel to the beginning of the change of the pixel gradation (appropriately referred to as "delay time" below) differs depending on the pixel. A difference in delay times depending on the pixel becomes the difference in gradation depending on the pixel and is visually recognized as display image noise. Noise such as this is noticeable as the duration of the voltage applied to display halftone is shorter.

According to experiments by the inventors, it is considered that the cause generating delay time is related to the presence of a threshold voltage for beginning to move the electrophoretic particles and that a sufficient voltage is not being applied to the electrophoretic layer unless sufficient charge is accumulated in the condenser 27. In order for a sufficient voltage to be applied to the pixel to begin moving the electrophoretic particles, it is necessary for a sufficient charge to accumulate in the condenser 27. However, if there are individual differences in the charging speeds of the condensers 27 due to manufacturing variations, it is considered that the required time from the application of a voltage to the condenser 27 to the sufficient voltage being applied to the pixel is different depending on the pixel. This phenomenon is considered to be one cause of a difference in delay time depending on the pixel.

Therefore, the driving method of the embodiment performs the preparation driving white writing (step ST20) of applying the positive polarity compensating voltage in preparation before performing the black writing (step ST30) of applying the negative polarity driving voltage for displaying halftone. The inventors found that by performing the preparation driving white writing (step ST20) before the black writing (step ST30), it is possible to reduce the difference in the movement amount of the electrophoretic particles depending on the pixel which are generated due to a difference in delay time depending on the pixel. As such, by performing the preparation driving white writing (step ST20), it is possible to reduce the display of a halftone which differs depending on the pixel when the same driving voltage is applied to different pixels. That is, it is possible to reduce display image noise.

As described above, according to the driving method of the electrophoretic display device of the embodiment, it is possible to reduce noise when displaying halftone and it is possible to perform a high quality display.

Figure 9:
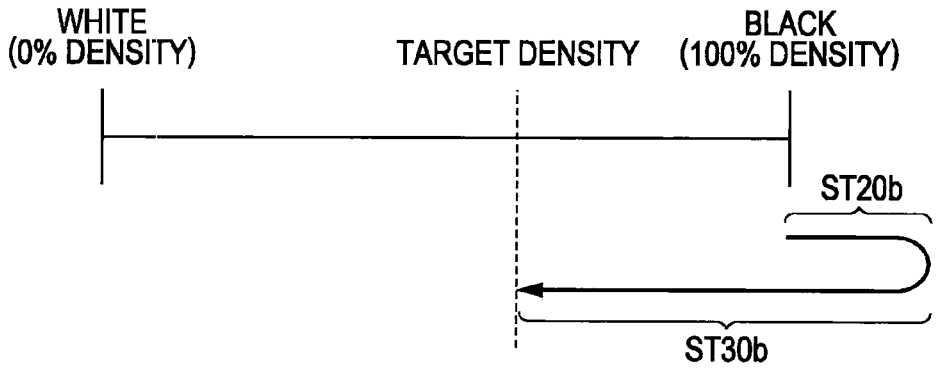
FIG. 9 is a conceptual diagram illustrating a driving method of an electrophoretic display device according to a modified example.

FIG. 9 is a conceptual diagram illustrating a driving method of an electrophoretic display device according to a modified example, and is a diagram with the same meaning as FIG. 7.

In the first embodiment described above, a case, where an image including halftone is displayed on the display unit 3 after the all white display (step ST10) is performed, is taken as an example. However, as in the modified example, an image including halftone may be displayed on the display unit 3 after all black display is performed (that is, after all of the pixels 20 display black).

That is, as shown in FIG. 9, in the driving method of the electrophoretic display device of the modified example, preparation driving black writing (step ST20*b*) and white writing (step ST30*b*) are performed in this order after the all black display is performed. In the preparation driving black writing (step ST20*b*), a negative polarity compensating voltage pulse with a duration Tc1 is applied to all of the pixels 20. That is, in the preparation driving black writing (step ST20*b*), a compensating voltage pulse is applied in the same manner as the first embodiment, but in the modified example, the polarity of the compensating voltage pulse is a negative polarity. In the white writing (step ST30*b*), a positive polarity driving voltage is applied only for a predetermined period of time to the pixels 20 which are to display gray so as to display the gray to be displayed (that is, target density of gray). In other words, a positive polarity driving voltage pulse with a duration set in advance according to the halftone to be displayed is applied to the pixels 20 which are to display halftone. In this manner, a gray (that is, target density of gray) to be displayed in the pixel 20 is displayed.

Even in the driving method of the electrophoretic display device of the modified example of this manner, it is possible to reduce noise when displaying halftone and it is possible to perform a high quality display in the same manner as the driving method of the electrophoretic display device of the first embodiment.

Second Embodiment

Next, a driving method of an electrophoretic display device according to a second embodiment is described with reference to FIG. 10.

Figure 10:
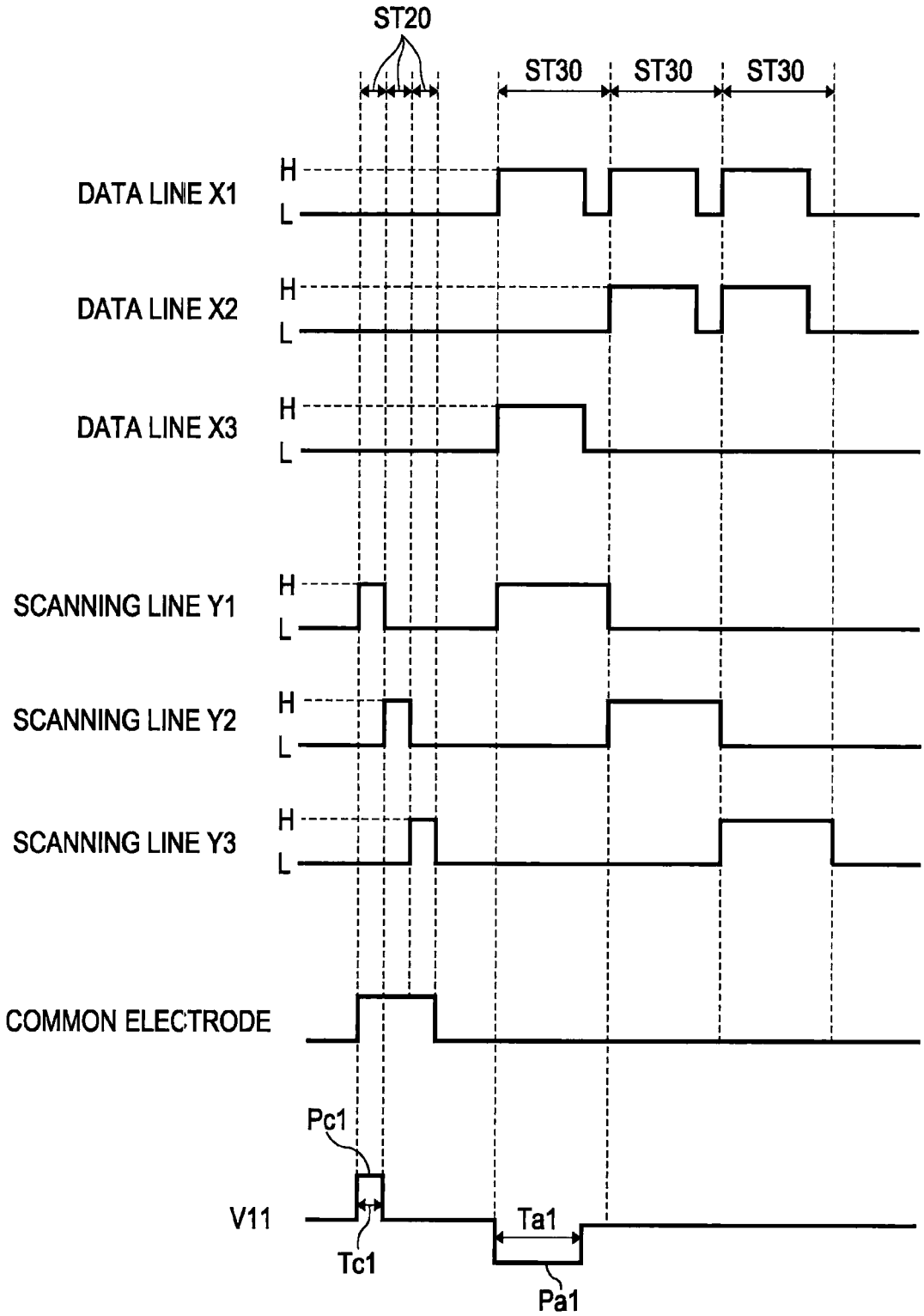
FIG. 10 is a timing chart for describing a driving method of an electrophoretic display device according to a second embodiment.

FIG. 10 is a timing chart for describing the driving method of the electrophoretic display device according to the second embodiment and is a diagram with the same meaning as FIG. 8 which illustrates the first embodiment described above.

In addition, points where the driving method of the electrophoretic display device according to the second embodiment differs from the driving method of the electrophoretic display device according to the first embodiment described above will mainly be described, and points which are similar to the driving method of the electrophoretic display device according to the first embodiment will not be included where appropriate. Additionally, even in the second embodiment, the case, where the image including halftone shown in FIG. 5 is displayed on the display unit 3, is taken as an example in the same manner as the first embodiment described above.

In the first embodiment described above with reference to FIG. 8, the preparation driving white writing (step ST20) and the black writing (step ST30) are performed for each time when each of the scanning lines Y1, Y2 and Y3 are selected. However, as in the second embodiment shown in FIG. 10, the black writing (step ST30) may be performed for all of the pixels 20 which are to display gray after the preparation driving white writing (step ST20) is performed for all of the pixels 20 in the display unit 3.

That is, as shown in FIG. 10, according to the driving method of the electrophoretic display device of the second embodiment, after the all white display (step ST10) which is not diagrammatically shown in FIG. 10 is performed, first, the scanning line Y1, the scanning line Y2 and the scanning line Y3 are sequentially selected, and the preparation driving white writing (step ST20) is performed for each time when each of the scanning lines 40 are selected. At this time, different to the first embodiment described above, the black writing (step ST30) is not performed. In other words, after the all white display (step ST10) is performed, first, the preparation driving white writing (step ST20) is performed for all of the pixels 20 in the display unit 3. That is, the positive polarity compensating voltage pulse Pc1 is applied to all of the pixels 20 in the display unit 3.

After the preparation driving white writing (step ST20) is performed for all of the pixels 20 in the display unit 3 in this manner, the scanning line Y1, the scanning line Y2 and the scanning line Y3 are sequentially selected again, and the black writing (step ST30) is performed for each time when each of the scanning lines 40 are selected. That is, the black writing (step ST30) is performed for all of the pixels 20 in the display unit 3 which are to display gray (that is, in the example shown in FIG. 5, the pixel PX(1,1), the pixel PX(1,3), the pixel PX(2,1), the pixel PX(2,2), the pixel PX(3,1), and the pixel PX(3,2)). That is, the negative polarity driving voltage pulse Pa1 is applied to all of the pixels 20 in the display unit 3 which are to display gray.

Even in the driving method of the electrophoretic display device of the second embodiment such as this, it is possible to reduce noise when displaying halftone and it is possible to perform a high quality display in the same manner as the driving method of the electrophoretic display device of the first embodiment described above compared to a case when halftone is displayed in the pixel 20 by, for example, applying only a negative polarity driving voltage pulse to the pixel 20 which is to display halftone.

Third Embodiment

Next, a driving method of an electrophoretic display device of a third embodiment will be described with reference to FIGS. 11 and 12.

Figure 11:
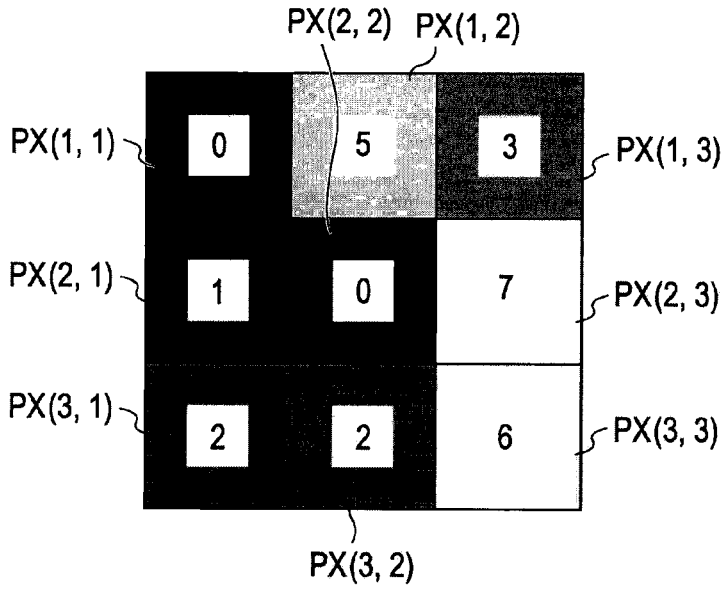
FIG. 11 is a schematic diagram illustrating the display unit of the electrophoretic display device in a state where an example of an image including a plurality of halftones is displayed.

Below, a case, where an image including a plurality of halftone as shown in FIG. 11 is display on the display unit 3, is taken as an example. Here, FIG. 11 is a schematic diagram illustrating the display unit of the electrophoretic display device in a state where an example of an image including a plurality of halftones is displayed. In addition, the image including a plurality of halftone shown in FIG. 11 is an image of 8 gradations, and the $0^{th}$ gradation corresponds to black, the $1^{st}$ gradation to the $6^{th}$ gradation correspond to grays which each have different densities, and the $7^{th}$ gradation corresponds to white.

That is, as shown in FIG. 11, a case where the pixel PX(1,1) displays the $0^{th}$ gradation, the pixel PX(1,2) displays the $5^{th}$ gradation, the pixel PX(1,3) displays the $3^{rd}$ gradation, the pixel PX(2,1) displays the $1^{st}$ gradation, the pixel PX(2,2) displays the $0^{th}$ gradation, the pixel PX(2,3) displays the $7^{th}$ gradation, the pixel PX(3,1) displays the $2^{nd}$ gradation, the pixel PX(3,2) displays the $2^{nd}$ gradation, and the pixel PX(3,3) displays the $6^{th}$ gradation, is taken as an example.

Figure 12:
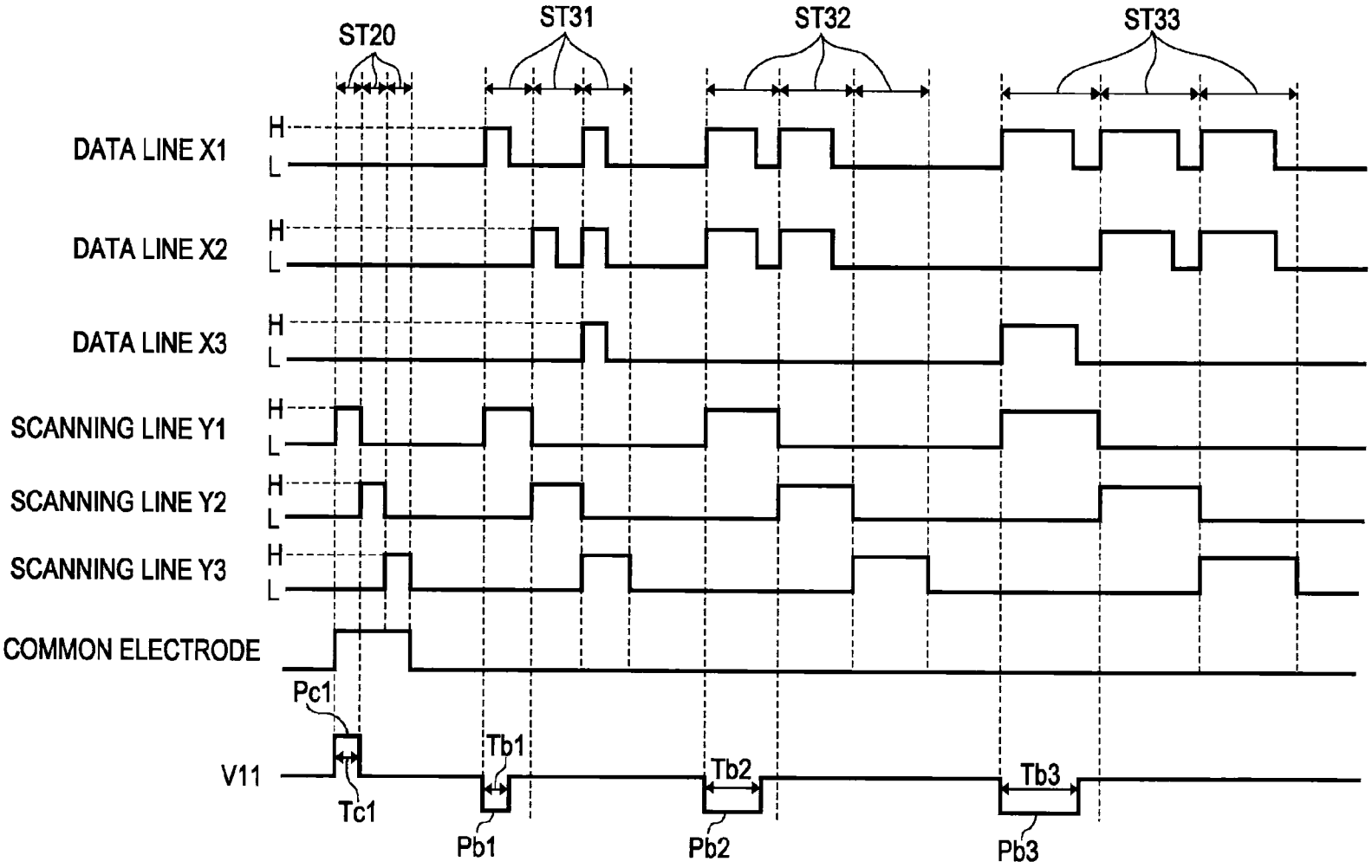
FIG. 12 is a timing chart for describing a driving method of an electrophoretic display device according to a third embodiment.

FIG. 12 is a timing chart for describing the driving method of the electrophoretic display device according to the third embodiment, and is a diagram with the same meaning as FIG. 10 which illustrates the second embodiment described above.

The driving method of the electrophoretic display device according to the third embodiment differs from the driving method of the electrophoretic display device according to the second embodiment described above in a point that it is a driving method of a case where an image including a polarity of halftone is displayed. Other points are typically similar to the driving method of the electrophoretic display device according to the second embodiment described above. As such, below, points where the driving method of the electrophoretic display device according to the third embodiment differs from the driving method of the electrophoretic display device according to the second embodiment described above will mainly be described, and description of points which are similar to the driving method of the electrophoretic display device according to the second embodiment will not be included where appropriate.

As shown in FIG. 12, according to the driving method of the electrophoretic display device of the third embodiment, after the preparation driving white writing (step ST20) is performed for all of the pixels 20, black writing (steps ST31, ST32 and ST33) is performed for the pixels 20 (that is, pixels 20 where are to display any of the $0^{th}$ gradation to the $6^{th}$ gradation) out the plurality of pixels 20 in the display unit 3 except for the pixel PX(2,3) which is to display the $7^{th}$ gradation (that is, white).

In addition, in the third embodiment, by combining three types of negative polarity driving voltage pulses Pb1, Pb2 and Pb3 where durations are different from each other, any of the gradations from the $0^{th}$ to the $7^{th}$ is displayed in the pixel 20. A duration Tb1 of the negative polarity driving voltage pulse Pb1 is four times a duration Tb3 of the negative polarity driving voltage pulse Pb3, and a duration Tb2 of the negative polarity driving voltage pulse Pb2 is two times the duration Tb3 of the negative polarity driving voltage pulse Pb3 (that is, half of the duration Tb1 of the negative polarity driving voltage pulse Pb1). However, the ratio of the durations may be appropriately set according to the ease of movement of the electrophoretic particles and the like so that the 8 gradations can be displayed. In a case when the negative polarity driving voltage pulses Pb1, Pb2 and Pb3 are applied to the pixel 20, the pixel 20 displays the $0^{th}$ gradation (that is, black). In a case when the negative polarity driving voltage pulses Pb2 and Pb3 are applied to the pixel 20, the pixel 20 displays the $1^{st}$ gradation. In a case when the negative polarity driving voltage pulses Pb1 and Pb3 are applied to the pixel 20, the pixel 20 displays the $2^{nd}$ gradation. In a case when only the negative polarity driving voltage pulse Pb3 is applied to the pixel 20, the pixel 20 displays the $3^{rd}$ gradation. In a case when the negative polarity driving voltage pulses Pb1 and Pb2 are applied to the pixel 20, the pixel 20 displays the $4^{th}$ gradation. In a case when only the negative polarity driving voltage pulse Pb2 is applied to the pixel 20, the pixel 20 displays the $5^{th}$ gradation. In a case when only the negative polarity driving voltage pulse Pb1 is applied to the pixel 20, the pixel 20 displays the $6^{th}$ gradation. In a case when neither the negative polarity driving voltage pulses Pb1, Pb2 nor Pb3 are applied to the pixel 20, the pixel 20 displays the $7^{th}$ gradation.

That is, as shown in FIG. 12, according to the driving method of the electrophoretic display device of the third embodiment, after the all white display (step ST10) which is not diagrammatically shown in FIG. 12 is performed, first, the scanning line Y1, the scanning line Y2 and the scanning line Y3 are sequentially selected, and the preparation driving white writing (step ST20) is performed where the positive polarity compensating voltage pulse Pc1 is applied each time when each of the scanning lines are selected. That is, the positive polarity compensating voltage pulse Pc1 is applied to all of the pixels 20 in the display unit 3.

Next, the scanning line Y1, the scanning line Y2 and the scanning line Y3 are sequentially selected again, and the black writing (step ST31) is performed where the negative polarity driving voltage pulse Pb1 is applied each time when each of the scanning lines are selected. In the black writing (step ST31), the negative polarity driving voltage pulse Pb1 is applied to the pixels 20 which are to display any of the $0^{th}$, the $2^{nd}$, the $4^{th}$ or the $6^{th}$ gradations (that is, in the example shown in FIG. 11, the pixel PX(1,1), the pixel PX(2,2), the pixel PX(3,1), the pixel PX(3,2) and the pixel PX(3,3)).

Next, the scanning line Y1, the scanning line Y2 and the scanning line Y3 are sequentially selected again, and the black writing (step ST32) is performed where the negative polarity driving voltage pulse Pb2 is applied each time when each of the scanning lines are selected. In the black writing (step ST32), the negative polarity driving voltage pulse Pb2 is applied to the pixels 20 which are to display any of the $0^{th}$, the $1^{st}$, the $4^{th}$ or the $5^{th}$ gradations (that is, in the example shown in FIG. 11, the pixel PX(1,1), the pixel PX(2,1), the pixel PX(1,2) and the pixel PX(2,2)).

Next, the scanning line Y1, the scanning line Y2 and the scanning line Y3 are sequentially selected again, and the black writing (step ST33) is performed where the negative polarity driving voltage pulse Pb3 is applied each time when each of the scanning lines are selected. In the black writing (step ST33), the negative polarity driving voltage pulse Pb3 is applied to the pixels 20 which are to display any from the $0^{th}$ to the $3^{rd}$ gradations (that is, in the example shown in FIG. 11, the pixel PX(1,1), the pixel PX(2,1), the pixel PX(3,1), the pixel PX(2,2) the pixel PX(3,2), and the pixel PX(1,3)).

After the preparation driving white writing (step ST20) is performed for all of the pixels 20 in the display unit 3 in this manner, the black writing (step ST31, ST32 and ST33) is performed. That is, after the positive polarity compensating voltage pulse Pc1 is applied to all of the pixels 20 in the display unit 3, negative polarity driving voltage pulses required for displaying a target gradation out of the negative polarity driving voltage pulses Pb1, Pb2 and Pb3 are applied to all of the pixels 20 in the display unit 3.

In a case when many gradations are displayed as shown in FIG. 11, in correspondence with a target gradation, it is necessary to apply driving voltage pulses with different durations such as the driving voltage pulse Pb1, the driving voltage pulse Pb2 and the driving voltage pulse Pb3. Additionally, in this case, the time required from when the preparation driving white writing (step ST20) is executed to the completion of the display is longer than the second embodiment. As already described, image noise has a tendency to be notably generated as the duration of the driving voltage applied to display halftone becomes shorter. Additionally, the effect of providing the preparation driving white writing (step ST20) according to the invention becomes larger as the interval between the preparation driving white writing (step ST20) and the black writing (step ST30) is shorter. Therefore, as shown in FIG. 12, as the black writing step which continues immediately after the preparation driving white writing (step ST20), it is preferable to provide the step ST31 of applying the driving voltage pulse Pb1 which has the shortest duration out of the driving voltage pulse Pb1, the driving voltage pulse Pb2 and the driving voltage pulse Pb3. According to this configuration, since it is possible to make the interval between the driving voltage pulse Pb1, which is applied to the pixel PX(3, 3) which is to display the $6^{th}$ gradation which is closest to the white display, and the preparation driving white writing (step ST20) as short as possible, the effect of reducing or eliminating image noise becomes the largest. Additionally, in a case when an interval from when one scanning line is scanned until it is scanned again is sufficiently short, a noise suppressing effect can be obtained even if the step ST31 of applying the driving voltage pulse Pb1 with the shortest duration is provided last.

According to the driving method of the electrophoretic display device of the third embodiment such as this, it is possible to display the image with a plurality of halftones shown in FIG. 11 on the display unit 3 with high quality.

Here, in the embodiment, as described above, when an image including a plurality of halftones as shown in FIG. 11 is displayed after the all white display (step ST10) is performed, the black writing (step ST31, ST32 and ST33) is performed after the preparation driving white writing (step ST20) is performed. Accordingly, it is possible to reduce or eliminate noise in an image displayed by the plurality of pixels 20 arranged in the display unit 3 using the preparation driving white writing (step ST20).

Furthermore, in the embodiment, the duration Tc1 of the positive polarity compensating voltage pulse Pc1 is shorter than the total duration of the negative polarity driving voltage pulses Pb1, Pb2 and Pb3 (that is, the sum of the durations Tb1, Tb2 and Tb3). As such, it is possible to effectively reduce or eliminate noise in a displayed image. Additionally, it is possible to swiftly display halftone compared to a case where the duration Tc1 of the positive polarity compensating voltage pulse Pc1 is longer than the total duration of the negative polarity driving voltage pulses Pb1, Pb2 and Pb3 (that is, it is possible to shorten a time required for the pixel 20 to display halftone to be displayed). Furthermore, it is possible to suppress power consumption required to apply the positive polarity compensating voltage pulse Pc1.

Fourth Embodiment

Next, a driving method of an electrophoretic display device of a fourth embodiment will be described with reference to FIG. 13.

Figure 13:
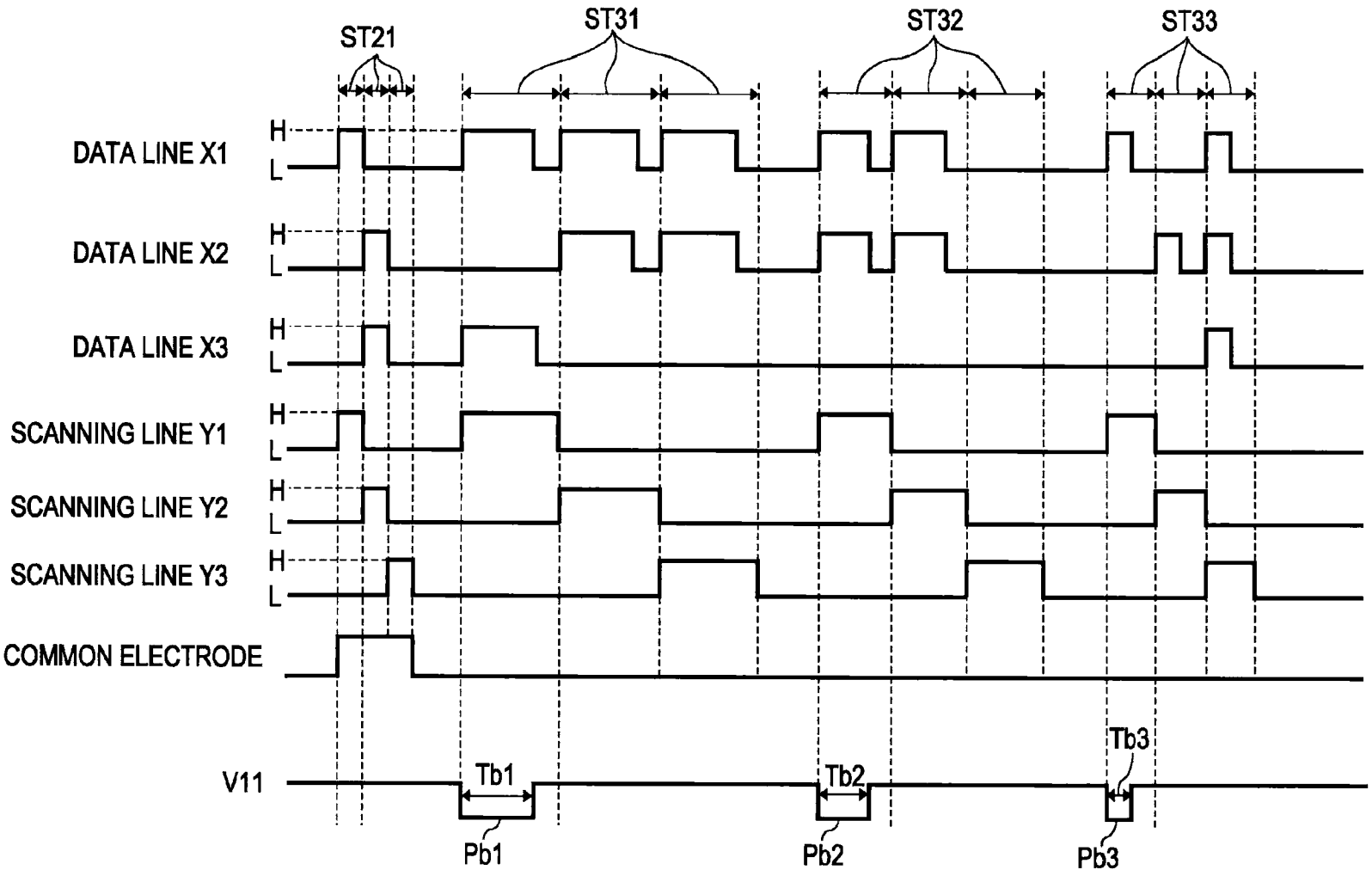
FIG. 13 is a timing chart for describing a driving method of an electrophoretic display device according to a fourth embodiment.

FIG. 13 is a timing chart for describing the driving method of the electrophoretic display device according to the fourth embodiment, and is a diagram with the same meaning as FIG. 12 which illustrates the third embodiment described above.

In addition, below, points where the driving method of the electrophoretic display device according to the fourth embodiment differs from the driving method of the electrophoretic display device according to the third embodiment described above will mainly be described, and points which are similar to the driving method of the electrophoretic display device according to the third embodiment will not be included where appropriate. Additionally, even in the fourth embodiment, the case, where the image including a plurality of halftone shown in FIG. 11 is displayed on the display unit 3, is taken as an example in the same manner as the third embodiment described above.

In the driving method of the electrophoretic display device according to the third embodiment described above, the black writing (steps ST31, ST32 and ST33) is performed after the preparation driving white writing (step ST20) is performed for all of the pixels 20. However, as in the embodiment, preparation driving white writing (step ST21) may be performed where the positive polarity compensating voltage pulse Pc1 is applied only to the pixels 20 displaying halftone. Furthermore, the step ST33, which is the application of the driving voltage pulse Pb3 which has the shortest duration out of the driving voltage pulse Pb1, the driving voltage pulse Pb2 and the driving voltage pulse Pb3, may be provided last.

That is, as shown in FIG. 13, according to the driving method of the electrophoretic display device according to the embodiment, the preparation driving white writing (step ST21) and the black writing (steps ST31, ST32 and ST33) are performed after the all white display (step ST10) is performed. In the preparation driving white writing (step ST21), the positive polarity compensating voltage pulse Pc1 is applied to the pixels 20 displaying halftone (that is, the pixels 20 displaying any of the $1^{st}$ to the $6^{th}$ gradations) and the positive polarity compensating voltage pulse Pc1 is not applied to the pixels 20 displaying the lowest $0^{th}$ gradation or the highest $7^{th}$ gradation. In other words, in the preparation driving white writing (step ST21), the common electrode 22 is set to the high potential VH, a data signal with the low potential VL is supplied in the pixel 20 displaying halftone, and a data signal with the high potential VH is supplied in the pixel 20 displaying the lowest gradation and the highest gradation. In the example shown in FIG. 13, in the preparation driving white writing (step ST21), the positive polarity compensating voltage pulse Pc1 is applied to the pixel PX(1,2), the pixel PX(1,3), the pixel PX(2,1), the pixel PX(3,1), the pixel PX(3,2), and the pixel PX(3,3) which are the pixels 20 displaying halftone, and the positive polarity compensating voltage pulse Pc1 is not applied to the pixel PX(1,1), the pixel PX(2,2), and the pixel PX(2,3) which are the pixels 20 displaying the lowest gradation and the highest gradation.

As such, for example, by applying the positive polarity compensating voltage pulse Pc1 to the pixel 20 displaying black (that is, the $0^{th}$ gradation), it is possible to prevent the deviation of color (or gradation) displayed by the pixel 20 to the white (that is, the $7^{th}$ gradation) side. Accordingly, it is not only possible to effectively reduce or eliminate noise in a displayed image but also it is possible to increase contrast.

The invention is not limited to the embodiments described above, and various modifications can be made within the spirit and the concept of the invention as stated in the scope of the claims and the specification, and a driving method of an electrophoretic display device according to the modifications is included in the technical scope of the invention.

The entire disclosure of Japanese Patent Application No. 2010-048060, filed Mar. 4, 2010 is expressly incorporated by reference herein.

What is claimed is:

1. A driving method of an electrophoretic display device, which has a plurality of pixels where an electrophoretic layer is interposed between a first electrode and a second electrode, and in a case when the potential of the first electrode is higher than the potential of the second electrode, the potential difference generated between the first electrode and the second electrode is a positive polarity, as a display state of one pixel out of the plurality of pixels, a white display state is selected by applying a voltage with the positive polarity and a black display state is selected by applying a voltage with a negative polarity different from the positive polarity, and a halftone between the white display state and the black display state is selected according to a total duration of the voltage with the negative polarity applied to the one pixel in the display state, comprising:

applying a setting voltage pulse with the positive polarity such that the display state of the one pixel is set to the white display state;

applying a compensating voltage pulse with the positive polarity to the one pixel, wherein the compensating voltage pulse is different from the setting voltage pulse and increases existing polarity between the first electrode and the second electrode; and applying a driving voltage pulse with the negative polarity to the one pixel, such that the one pixel is displayed in the halftone, wherein, the applying of the compensating voltage pulse is executed between the applying of the setting voltage pulse and the applying of the first driving voltage pulse.

2. The driving method of an electrophoretic display device according to claim 1, wherein, in the applying of the driving voltage pulse, at least two or more driving voltage pulses with the negative polarity are applied to the one pixel, and a driving voltage pulse with the shortest duration out of the at least two or more driving voltage pulses with the negative polarity is applied to the one pixel before the other driving voltage pulses.

3. The driving method of an electrophoretic display device according to claim 1, the electrophoretic display device further comprising a plurality of scanning lines and a plurality of data lines, wherein, a first pixel out of the plurality of pixels corresponds to a first scanning line out of the plurality of scanning lines and a second pixel out of the plurality of pixels corresponds to a second scanning line out of the plurality of scanning lines, a display state of the first pixel and a display state of the second pixel are set to the white display state in the applying of the setting voltage pulse, the applying of the compensating voltage pulse and the applying of the driving voltage pulse are executed with regard to the first pixel when the first scanning line is selected, and the applying of the compensating voltage pulse and the applying of the driving voltage pulse are executed with regard to the second pixel when the second scanning line is selected.

4. The driving method of an electrophoretic display device according to claim 1, wherein, the duration of the compensating voltage pulse is shorter than the total duration of the driving voltage pulse with the negative polarity.

5. The driving method of an electrophoretic display device according to claim 1, wherein, the duration of the compensating voltage pulse is longer than the total duration of the driving voltage pulse with the negative polarity.

6. The driving method of an electrophoretic display device according to claim 1, wherein, the applying of the compensating voltage pulse is not executed with regard to a pixel where the black display state is selected out of the plurality of pixels.

7. A controller for controlling an electrophoretic display device, which has a plurality of pixels where an electrophoretic layer is interposed between a first electrode and a second electrode, and in a case when the potential of the first electrode is higher than the potential of the second electrode, the potential difference generated between the first electrode and the second electrode is a positive polarity, as a display state of one pixel out of the plurality of pixels, a white display state is selected by applying a voltage with the positive polarity and a black display state is selected by applying a voltage with a negative polarity different from the positive polarity, and a halftone between the white display state and the black display state is selected according to a total duration of the voltage with the negative polarity applied to the one pixel in the white display state, the controller executing a driving method comprising:

applying a setting voltage pulse with the positive polarity such that the display state of the one pixel is set to the white display state;

applying a compensating voltage pulse with the positive polarity to the one pixel, wherein the compensating voltage pulse is different from the setting voltage pulse and increases existing polarity between the first electrode and the second electrode; and applying a driving voltage pulse with the negative polarity to the one pixel, such that the one pixel is displayed in the halftone, wherein, the applying of the compensating voltage pulse is executed between the applying of the setting voltage pulse and the applying of the first driving voltage pulse.

8. The controller according to claim 7, wherein, in the applying of the driving voltage pulse, at least two or more driving voltage pulses with the negative polarity are applied to the one pixel, and a driving voltage pulse with the shortest duration out of the at least two or more driving voltage pulses with the negative polarity is applied to the one pixel before the other driving voltage pulses.

9. The controller according to claim 7, the electrophoretic display device further comprising a plurality of scanning lines and a plurality of data lines, wherein, a first pixel out of the plurality of pixels corresponds to a first scanning line out of the plurality of scanning lines and a second pixel out of the plurality of pixels corresponds to a second scanning line out of the plurality of scanning lines, a display state of the first pixel and a display state of the second pixel are set to the white display state in the applying of the setting voltage pulse, the applying of the compensating voltage pulse and the applying of the driving voltage pulse are executed with regard to the first pixel when the first scanning line is selected, and the applying of the compensating voltage pulse and the applying of the driving voltage pulse are executed with regard to the second pixel when the second scanning line is selected.

10. The controller according to claim 7, wherein, the duration of the compensating voltage pulse is shorter than the total duration of driving voltage pulse with the negative polarity.

11. The controller according to claim 7, wherein, the duration of the compensating voltage pulse is longer than the total duration of the driving voltage pulse with the negative polarity.

12. The controller according to claim 7, wherein, the applying of the compensating voltage pulse is not executed with regard to a pixel where the black display state is selected out of the plurality of pixels.

13. A driving method of an electrophoretic display device that has a plurality of pixels where an electrophoretic layer is interposed between a first electrode and a second electrode, the method comprising:

applying a setting voltage pulse with a first polarity such that a display state of one pixel of the plurality of pixels is set to an extreme display state;

applying a compensating voltage pulse with the first polarity to the one pixel, wherein the compensating voltage pulse is different from the setting voltage pulse and increases existing polarity between the first electrode and the second electrode; and applying a drive voltage pulse with a second polarity that is opposite to the first polarity to the one pixel such that the one pixel is displayed in a halftone state, wherein the halftone state is between the extreme display state and an either extreme display state.

14. A driving method of an electrophoretic display device, which has a plurality of pixels where an electrophoretic layer is interposed between a first electrode and a second electrode, and in a case when the potential of the first electrode is higher than the potential of the second electrode, the potential difference generated between the first electrode and the second electrode is a positive polarity, as a display state of one pixel out of the plurality of pixels, an extreme display state is selected by applying a voltage with the positive polarity and an either extreme display state is selected by applying a voltage with a negative polarity different from the positive polarity, and a halftone between the extreme display state and the either extreme display state is selected according to a total duration of the voltage with the negative polarity applied to the one pixel in the extreme display state, comprising:

applying a setting voltage pulse with the positive polarity such that the display state of the one pixel is set to the extreme display state;

applying a compensating voltage pulse with the positive polarity to the one pixel, wherein the compensating voltage pulse is different from the setting voltage pulse and increases existing polarity between the first electrode and the second electrode; and applying a driving voltage pulse with the negative polarity to the one pixel, such that the one pixel is displayed in the halftone, wherein the applying of the compensating voltage pulse is executed between the applying of the setting voltage pulse and the applying of the first driving voltage pulse.

* * * * *